US009689173B2

(12) United States Patent
Wu et al.

(10) Patent No.: US 9,689,173 B2
(45) Date of Patent: Jun. 27, 2017

(54) STRUCTURE ATTACHED WITH VIBRATION CONTROL DEVICE

(71) Applicant: Hory Corporation, Tokyo (JP)

(72) Inventors: DongHang Wu, Tokyo (JP); Akiyoshi Takamiya, Tokyo (JP); Takashi Nagumo, Tokyo (JP); Haruhiko Hirata, Tokyo (JP)

(73) Assignee: HORY CORPORATION, Tokyo (JP)

( * ) Notice: Subject to any disclaimer, the term of this patent is extended or adjusted under 35 U.S.C. 154(b) by 0 days.

(21) Appl. No.: 14/841,897

(22) Filed: Sep. 1, 2015

(65) Prior Publication Data

US 2017/0058514 A1 Mar. 2, 2017

(51) Int. Cl.
*E04B 1/98* (2006.01)
*E04H 9/02* (2006.01)

(52) U.S. Cl.
CPC ..... *E04H 9/021* (2013.01); *E04B 1/98* (2013.01); *E04H 9/02* (2013.01); *E04H 9/024* (2013.01)

(58) Field of Classification Search
CPC .. E04B 1/98; E04H 9/021; E04H 9/02; E04H 9/024
USPC ..... 52/167.3
See application file for complete search history.

(56) References Cited

U.S. PATENT DOCUMENTS 2,247,886 A * 7/1941 McLaughlin, Jr. ..... E04B 2/56 52/578
5,491,938 A * 2/1996 Niwa ..... E04H 9/02 52/167.1
8,407,942 B1 * 4/2013 Jones ..... E05B 17/2084 292/346
8,938,915 B2 * 1/2015 Jones ..... E05B 17/2084 292/346
2002/0129568 A1 * 9/2002 Oka ..... E04H 9/02 52/167.3
2008/0016793 A1 * 1/2008 Majlessi ..... E04B 1/24 52/167.3

(Continued)

FOREIGN PATENT DOCUMENTS

JP 62-211469 A 9/1987
JP 01203543 A * 8/1989

(Continued)

*Primary Examiner* — Adriana Figueroa
(74) *Attorney, Agent, or Firm* — Hankin Patent Law, APC; Kevin Schraven; Anooj Patel

(57) ABSTRACT

A construction component provided with a vibration damper includes a quadrangular frame in a front elevational view including four structural members, and the vibration damper includes: a vibration damping tool provided inside the frame; and four braces radially extending from the vibration damping tool and connected to the frame. The vibration energy deforming the frame is transmitted via the braces to the vibration damping tool to plastically deform the vibration damping tool, thereby absorbing the vibration energy in the vibration damping tool to damp vibration. The construction component further includes a bridging member configured to bridge a gap between two facing members of the four structural members. A part of the bridging member configured to overlap with the vibration damping tool in the front elevational view is defined as an interference avoidance portion in which interference between the part and the vibration damping tool is avoided.

8 Claims, 13 Drawing Sheets

(56) References Cited

U.S. PATENT DOCUMENTS

| | | | | |
|---|---|---|---|---|
| 2010/0058686 | A1* | 3/2010 | Henriquez | E04B 1/14 52/220.2 |
| 2015/0135611 | A1* | 5/2015 | Beard | E04B 1/24 52/167.3 |
| 2016/0244966 | A1* | 8/2016 | Miyazawa | E04B 1/98 |

FOREIGN PATENT DOCUMENTS

| | | | | |
|---|---|---|---|---|
| JP | 11-131860 | A | | 5/1999 |
| JP | 2000-027483 | A | | 1/2000 |
| JP | 2001-336304 | A | | 12/2001 |
| JP | 2006-161846 | A | | 6/2006 |
| JP | 2006274613 | A | * | 10/2006 |
| JP | 2009-036003 | A | | 2/2009 |
| JP | 2010-095901 | A | | 4/2010 |
| JP | 2012-132148 | A | | 7/2012 |
| JP | 2014-148859 | A | | 8/2014 |
| JP | 2014-211087 | A | | 11/2014 |
| JP | 2014-240599 | A | | 12/2014 |

* cited by examiner

STRUCTURE ATTACHED WITH VIBRATION CONTROL DEVICE

FIELD

The present invention relates to a construction component provided with a vibration damper for damping vibration generated by an earthquake and the like. The invention is applicable to various constructions such as buildings built by a two-by-four construction method.

BACKGROUND

Patent Literature 1 (JP-A-2012-132148) discloses a construction component provided with a vibration damper for damping vibration generated by an earthquake and the like. The construction component (building component) includes a quadrangular frame that is quadrangular in a front elevational view and is provided by members including four structural members. A vibration damping tool is connected to an inner side of the quadrangular frame using four braces radially extending from the vibration damping tool. When vibration energy is generated by an earthquake and the like and deforms the quadrangular frame, the vibration energy is transmitted to the vibration damping tool via the braces to plastically deform the vibration damping tool, so that the vibration energy is absorbed in the vibration damping tool to damp vibration.

In a building component used in the two-by-four construction method for the buildings (constructions), a center post is occasionally provided at a center position between right and left posts in order to reinforce strength of the quadrangular frame including the four structural members (i.e., the right and left posts, and upper frame member and lower frame member being vertically disposed between the posts). The center post is a bridging member that bridges a gap between two structural members (i.e., the upper frame member and the lower frame member) vertically disposed to face each other. When the bridging member is disposed inside the quadrangular frame, since the vibration damping tool of the vibration damper is located at a position overlapping with a part of the bridging member in a front elevational view, some treatment is required for avoiding an interference between the vibration damping tool and the bridging member.

An object of the invention is to provide a construction component provided with a vibration damper, the construction component being capable of avoiding an interference between a vibration damping tool of the vibration damper and a bridging member provided to an inner side of a quadrangular frame.

BRIEF SUMMARY OF THE INVENTION

According to an aspect of the invention, a construction component provided with a vibration damper includes a quadrangular frame that is quadrangular in a front elevational view and is provided by members including four structural members; the vibration damper including: a vibration damping tool provided to an inner side of the quadrangular frame; and four braces radially extending from the vibration damping tool and connected to the quadrangular frame, in which the quadrangular frame is deformable by vibration energy and the vibration energy is transmitted via the braces to the vibration damping tool to plastically deform the vibration damping tool, thereby absorbing the vibration energy in the vibration damping tool to damp vibration; and a bridging member configured to bridge a gap between two facing structural members of the four structural members, in which a part of the bridging member is configured to overlap with the vibration damping tool in the front elevational view is defined as an interference avoidance portion in which an interference between the part and the vibration damping tool is avoided in a right-angular view in a direction orthogonal to the front elevational view.

In the above aspect of the invention, the part of the bridging member overlaps with the vibration damping tool of the vibration damper in the front elevational view. The overlapping part is defined as the interference avoidance portion in which an interference between the overlapping part and the vibration damping tool is avoided in the right-angular view in the direction orthogonal to the front elevational view. Accordingly, the vibration damping tool of the vibration damper does not interfere with the bridging member provided inside the quadrangular frame. In other words, the vibration damping tool and the bridging member can be disposed inside the quadrangular frame without mutual interference.

It should be noted that the right-angular view in the direction orthogonal to the front elevational view refers to a lateral side view, a plan view or a bottom view.

In the above aspect of the invention, the interference avoidance portion defined by the overlapping part in which interference between the overlapping part and the vibration damping tool is avoided in the right-angular view in the direction orthogonal to the front elevational view can be realized in various exemplary embodiments.

In a first exemplary embodiment of the interference avoidance portion, the interference avoidance portion is provided by a concave portion provided to the bridging member, the concave portion receiving the vibration damping tool.

In a second exemplary embodiment of the interference avoidance portion, the interference avoidance portion is provided by an area defined by divided members of the bridging member, in which the divided members are prepared by dividing the bridging member at a position where the vibration damping tool is placed, and the divided members are connected to each other through a connector provided at a position shifted from the vibration damping tool.

When the interference avoidance portion is provided by the concave portion that is capable of receiving the vibration damping tool and is provided to the bridging member in the same manner as in the first exemplary embodiment, the bridging member may have a cut portion formed by cutting a bridging-member material in a middle of a length direction thereof, the bridging-member material having a cross section orthogonal to the length direction that is continuously constant in the length direction, in which the cut portion reaches two surfaces on both sides in a width direction of the bridging-member material in the front elevational view and has a depth from a surface of the bridging-member material. The cut portion may define the concave portion.

With this arrangement, the interference between the part of the bridging member and the vibration damping tool can be avoided with a simple arrangement in which the cut portion is formed by cutting the bridging-member material in the middle of the length direction thereof, the bridging-member material having the cross section orthogonal to the length direction that is continuously constant in the length direction.

The interference avoidance portion in the form of the cut portion in the bridging member can function more effectively by the arrangement in which the vibration damping tool is shifted from a center position in a depth direction of the quadrangular frame in the front elevational view toward the surface of the bridging-member material defining a surface of the bridging member.

Moreover, when the bridging member is provided by forming the cut portion in the bridging-member material as described above, a reinforcing member may be bonded to at least one of the two surfaces of both the sides in the width direction of the bridging member in the front elevational view.

With this arrangement, strength of the bridging member can be reinforced by the reinforcing member even when the cut portion is formed on the bridging member.

When the reinforcing member is thus bonded to at least one of the two surfaces of both the sides in the width direction of the bridging member in the front elevational view, the reinforcing member may have a length in the length direction of the bridging member, the length being sufficient for an area of the bridging member including the cut portion to be covered and may have a dent having the same shape as that of the cut portion at a position corresponding to the cut portion.

With this arrangement, since the strength of a part of the bridging member where the cut portion is formed can be reinforced by the reinforcing member and the dent having the same shape as that of the cut portion is formed on the reinforcing member at the position corresponding to the cut portion, mutual interference between the reinforcing member and the vibration damping tool can be avoided.

In this arrangement, the reinforcing member may be provided to one or both of the two surfaces of both the sides in the width direction of the bridging member in the front elevational view.

When the reinforcing member is provided to the two surfaces of both the sides in the width direction of the bridging member in the front elevational view, the strength of the bridging member can be further secured.

Further, the reinforcing member may include: a plate portion having a length in the length direction of the bridging member; and a rising portion formed on the plate portion along the length direction of the bridging member.

With this arrangement, since the rising portion is formed on the plate portion, rigidity of the reinforcing member can be improved. Accordingly, a large strength of the bridging member can be ensured.

Moreover, the reinforcing member may include a plurality of stopper holes for fixing the reinforcing member to the bridging member using a stopper, and the stopper holes are asymmetrically arranged on the reinforcing member relative to a center position of the length direction of the bridging member.

When the reinforcing member is disposed to each of the two surfaces on both the sides in the width direction of the bridging member, as long as a plurality of reinforcing members of the same type are prepared and disposed so that the reinforcing members are reverse to each other relative to the center position, locations of the stopper holes do not mutually interfere in the right-angular view. With this arrangement, when the reinforcing member is fixed with the stoppers to each of the two surfaces of the bridging member, since the locations of the stopper holes are shifted from each other, the stoppers do not mutually interfere when the stoppers are squeezed into the bridging member through the stopper holes. Accordingly, even when the plurality of reinforcing members are provided across the bridging member, only one type of the reinforcing member is required, so that a construction cost can be saved.

Moreover, in this arrangement, the bridging member provided inside the quadrangular frame may be provided by a post of which a length direction is a vertical direction or a bar of which a length direction is a horizontal direction.

Specifically, when the four structural members of the quadrangular frame are provided by the right and left posts and the upper frame member and the lower frame member being vertically disposed between the posts and the bridging member is provided by the post of which the length direction is the vertical direction, the bridging member may be defined by a center post disposed at the center position of the right and left posts. Moreover, when the bridging member is provided by the bar of which the length direction is the horizontal direction, the bridging member may be defined by a horizontally bridging member disposed between the upper frame member and the lower frame member.

The invention is applicable to any constructions such as buildings, underground structures and bridges.

The buildings may be a building built by a two-by-four construction method, a building built by a panel construction method, a building built by a unit construction method, a steel-framed building built by a steel framework construction method, or a wooden building built by a wooden framework construction method.

According to the aspect of the invention, even when the vibration damping tool of the vibration damper and the bridging member are provided inside the quadrangular frame, an advantage of avoiding mutual interference between the vibration damping tool and the bridging member can be obtained.

DETAILED DESCRIPTION OF THE INVENTION

Figure 1:
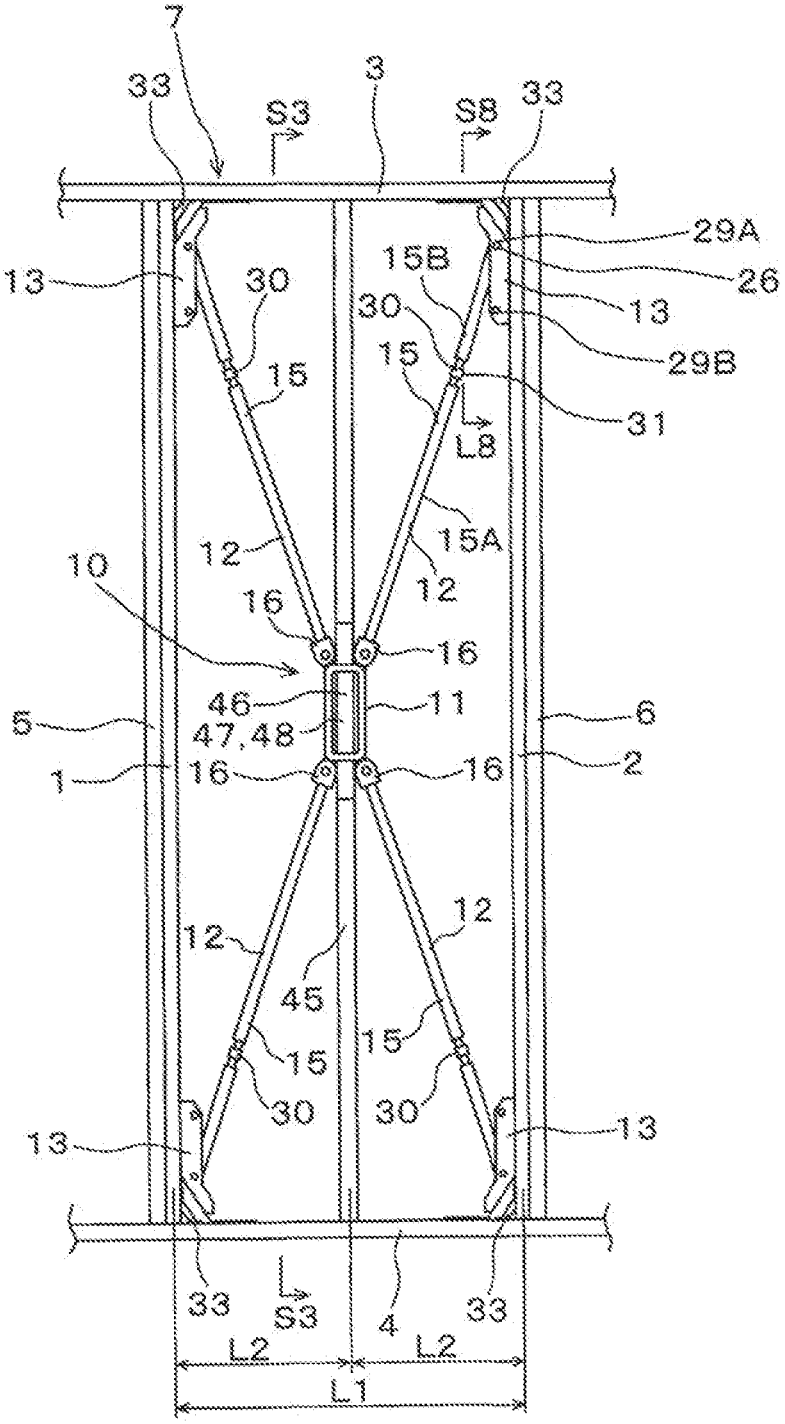
FIG. 1 is a front elevational view showing a quadrangular frame provided with a vibration damper according to a first exemplary embodiment of the invention.

Exemplary embodiment(s) of the invention will be described below with reference to the attached drawings. FIG. 1 is a front elevational view showing a building component (construction component). The building component is defined by a quadrangular frame 7 provided by four structural members 1 to 4 (main members). Since a construction component according to an exemplary embodiment of the invention is used in a two-by-four construction method, the quadrangular frame 7 (main component) shown in a front elevational view in FIG. 1 is provided with posts 1 and 2 on right and left sides, and an upper frame member 3 and a lower frame member 4 which are vertically disposed between the posts 1 and 2. In the exemplary embodiment, reinforcing posts 5 and 6 are respectively disposed on horizontally outer sides of the posts 1 and 2 along the posts 1 and 2 in the front elevational view. Thus, the quadrangular frame 7 includes the posts 1 and 2, the upper frame member 3, the lower frame member 4 and the reinforcing posts 5 and 6 (all wooden members), among which adjacent members are mutually connected by a nail and the like.

The vibration damper 10 is provided inside the quadrangular frame 7. The vibration damper 10 includes a vibration damping tool 11 and four braces 12 radially extending from the vibration damping tool 11 in a front elevational view. Each of the braces 12 is connected to the quadrangular frame 7 through a brace bracket 13 disposed at each corner of the quadrangular frame 7.

Figure 2:
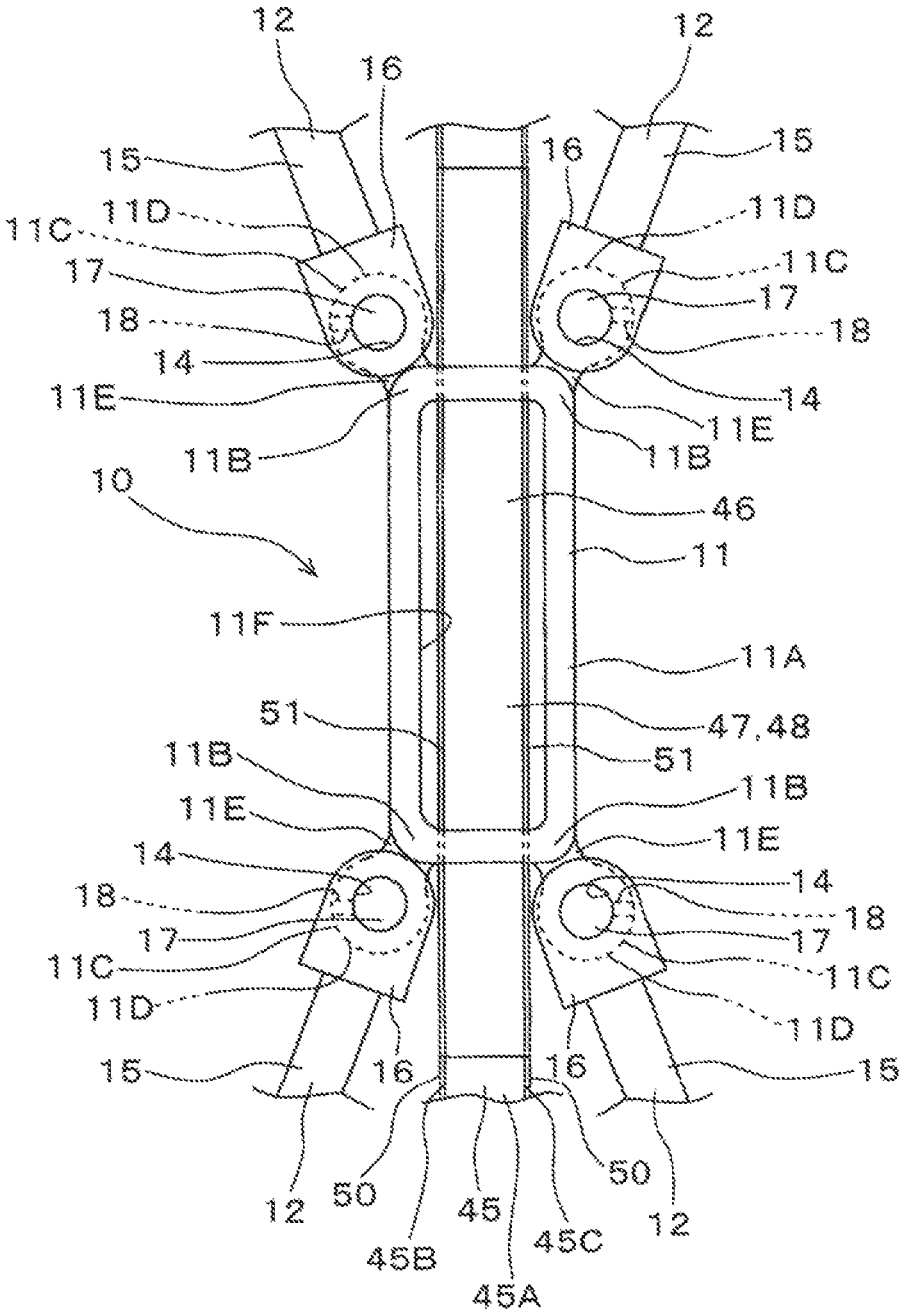
FIG. 2 is an enlarged front-elevational view showing a part of a vibration damping tool of the vibration damper in FIG. 1.

FIG. 2 is an enlarged front-elevational view showing the vibration damping tool 11. The vibration damping tool 11 arranged at the center inside the quadrangular frame 7 is made of aluminum, aluminum alloy or soft iron. The vibration damping tool 11 includes: a quadrangular or substantially quadrangular main body 11A having four corners 11B in the front elevational view; and a projection 11C projecting from the main body 11A at each of the corners 11B in an extension direction of each of the braces 12. The projection 11C includes: a ring 11D to which the brace 12 is connected; and a connecting portion 11E for connecting the ring 11D to the main body 11A. The ring 11D has a through hole 14. The main body 11A has a quadrangular or substantially quadrangular hollow portion 11F.

Figure 3:
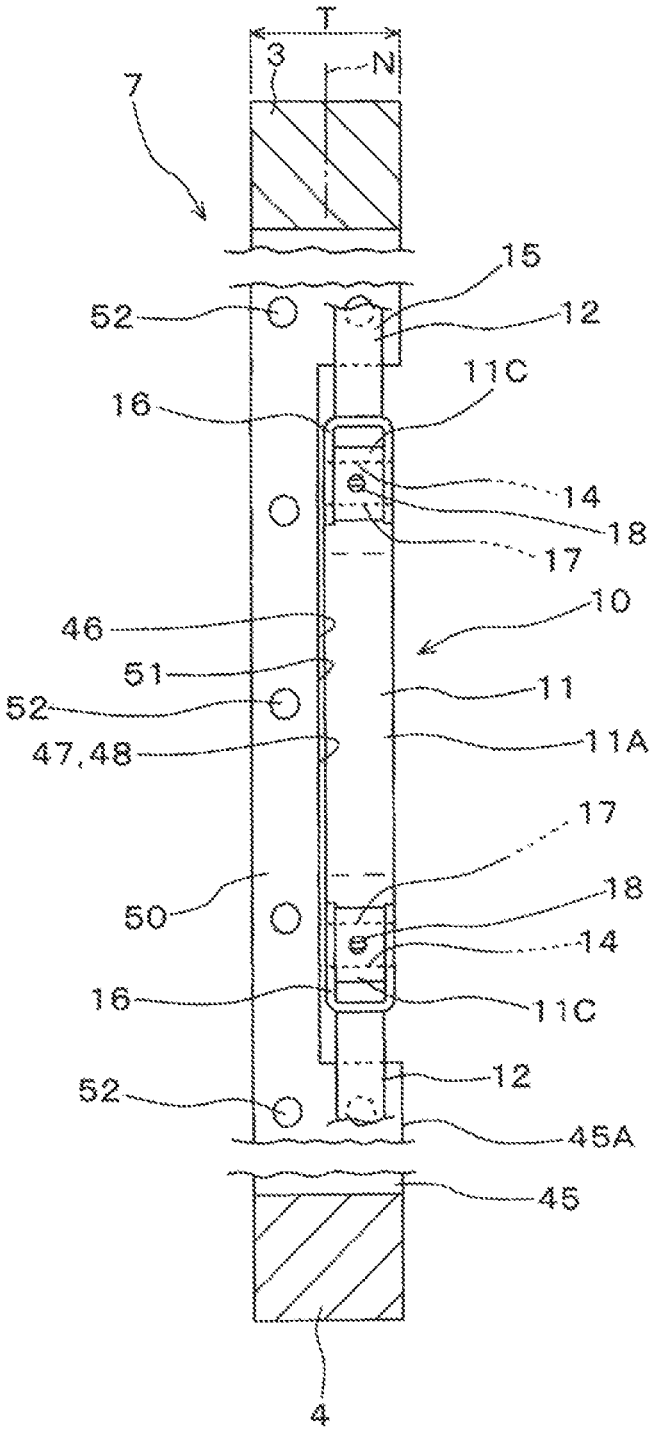
FIG. 3 is a cross sectional view of FIG. 1 taken along an S3-S3 line.

FIG. 3 is a cross sectional view of FIG. 1 taken along the S3-S3. As seen from FIG. 3, a thickness of the projection 11C of the vibration damping tool 11, in other words, a depth of the projection 11C in the front elevational view as shown in FIGS. 1 and 2, is smaller than that of the main body 11A. As shown in FIG. 1, each of the braces 12 includes: a stick-shaped brace body 15 formed of a tubular material; and a connector 16 welded to an end of the brace body 15 near the vibration damping tool 11. As shown in FIG. 3, while the U-shaped connector 16 obtained by bending a sheet metal is fitted to an outside of the projection 11C of the vibration damping tool 11, a pin 17 is inserted into a hole formed on the connector 16 and the hole 14 of the projection 11C, whereby each of the braces 12 is connected to the vibration damping tool 11 in such a manner to be rotatable around the pin 17.

As shown in FIG. 3, a width of the U-shaped connector 16, in other words, a depth of the connector 16 in the front elevational view shown in FIG. 2, is the same as or substantially the same as that of the main body 11A of the vibration damping tool 11. Accordingly, when the connector 16 is fitted to the outside of the projection 11C of the vibration damping tool 11, the projection 11C is flush with or substantially flush with the main body 11A of the vibration damping tool 11.

As shown in FIGS. 2 and 3, a screw hole into which a setscrew 18 is screwed is formed on the projection 11C of the vibration damping tool 11. By screwing the setscrew 18 into the screw hole until the setscrew 18 contacts with the pin 17, the pin 17 is prevented from slipping off the connector 16 and the projection 11C.

Figure 5:
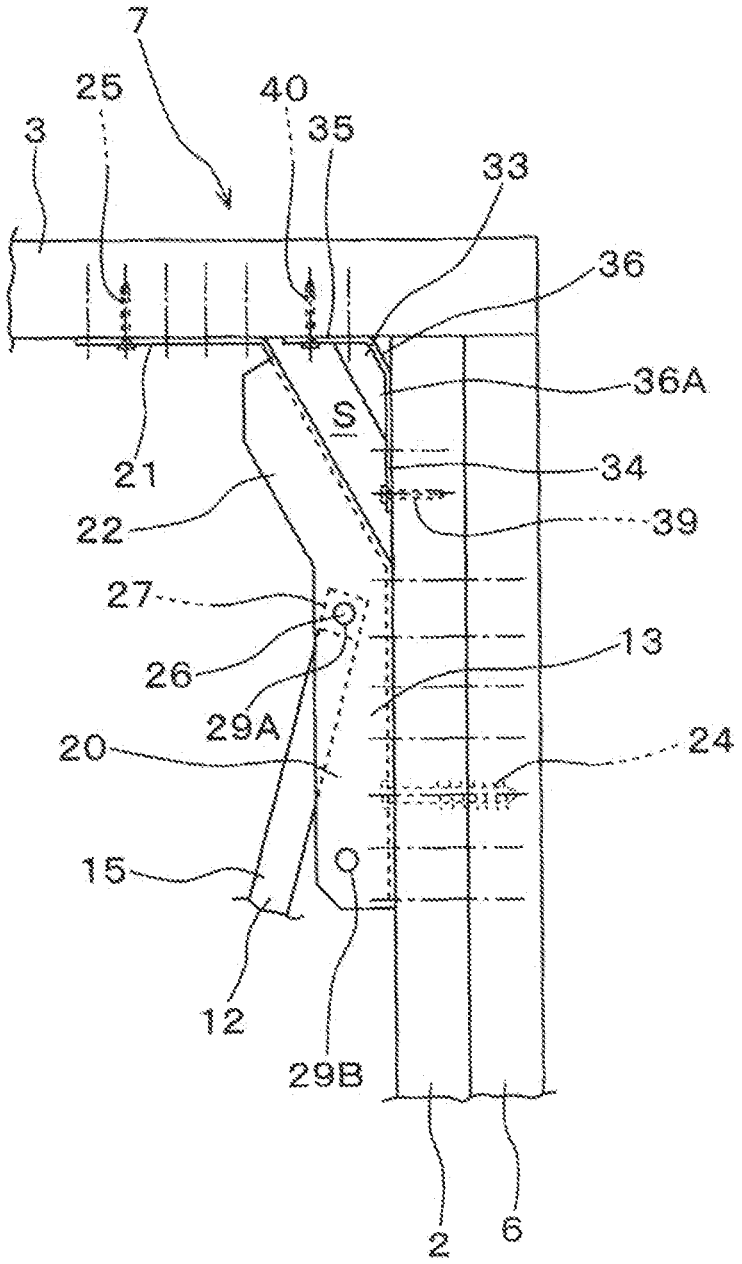
FIG. 5 is an enlarged front-elevational view showing a part of a brace bracket for connecting a brace of the vibration damper to the quadrangular frame in FIG. 1.
Figure 6A:
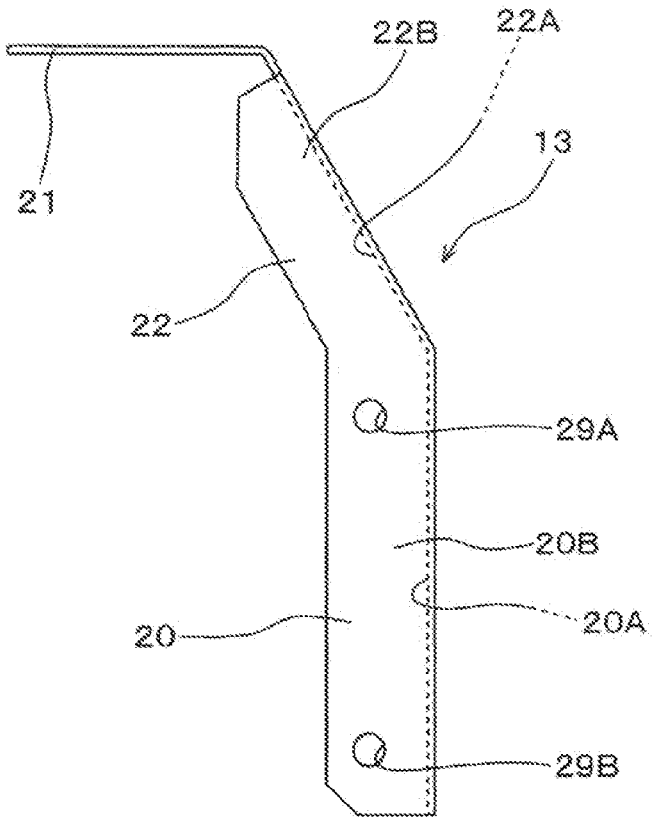
FIG. 6A is a front elevational view showing the bracket in FIG. 5.
Figure 6B:
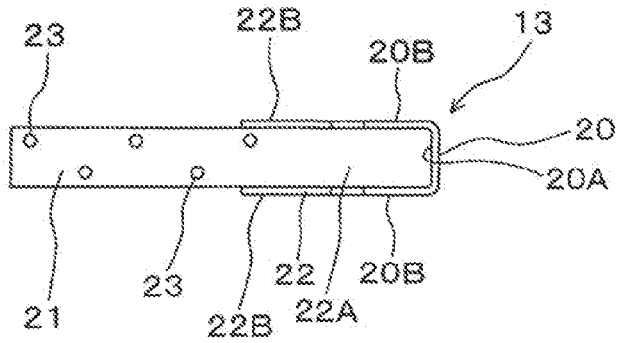
FIG. 6B is a bottom view showing the bracket in FIG. 5.

FIG. 5 shows a front elevational view of the brace bracket 13 for connecting each of the braces 12 to the quadrangular frame 7. FIGS. 6A and 6B are respectively the front elevational view and a bottom view showing the brace bracket 13 formed, for instance, by bending a sheet metal. The brace bracket 13 includes: a vertical portion 20 extending in a vertical direction; a horizontal portion 21 extending in a horizontal direction; and an inclined connecting portion 22 connecting a longitudinal end of the vertical portion 20 near the horizontal portion 21 and a longitudinal end of the horizontal portion 21 near the vertical portion 20. The vertical portion 20 includes: a bottom 20A; and a pair of flanges 20B vertically provided on both sides of the bottom 20A in a width direction (i.e., a depth direction in the front elevational view shown in FIGS. 5 and 6). The inclined connecting portion 22 includes: a bottom 20A continuous to the bottom 20A of the vertical portion 20; and a pair of flanges 22B vertically provided on both sides of the bottom 22A in a depth direction of the bottom 22A in the front elevational view shown in FIGS. 5 and 6, the flanges 22B being continuous to the pair of the flanges 20B of the vertical portion 20. The horizontal portion 21 is provided in a form of a plate continuous to the bottom 22A of the inclined connecting portion 22.

As shown in FIG. 6B, a plurality of nail holes 23 into which nails (stoppers) for fixing the brace brackets 13 to the quadrangular frame 7 are formed on the horizontal portion 21. Such nail holes are also formed on the bottom 20A of the vertical portion 20.

As shown in FIG. 1, the brace brackets 13 are respectively placed at four corners of the quadrangular frame 7. As shown in FIG. 5, the vertical portions 20 of the brace bracket 13 are fixed to the posts 1 and 2 (vertical members extending in the vertical direction) of the main structural members defining the quadrangular frame 7 (i.e., the posts 1 and 2, the upper frame member 3 and the lower frame member 4) using nails 24 inserted in the above nail holes formed on the bottom 20A of the vertical portion 20. The horizontal portions 21 of the brace brackets 13 are fixed to the upper frame member 3 and the lower frame member 4 (horizontal members extending in the horizontal direction) using nails 25 inserted in the nail holes 23 formed on the horizontal portion 21.

In the exemplary embodiment, as shown in FIG. 5, each of the nails 24 for fixing the vertical portions 20 of the brace bracket 13 to the posts 1 and 2 has a length enough to penetrate the posts 1 and 2. Since the nails 24 reach the reinforcing posts 5 and 6, the brace brackets 13 are fixed to both of the posts 1 and 2 and the reinforcing posts 5 and 6 using the nails 24 each having the length enough to penetrate the posts 1 and 2 and the reinforcing posts 5 and 6. With this arrangement, the attachment strength of the brace brackets 13 to the quadrangular frame 7 can be increased.

Figure 8:
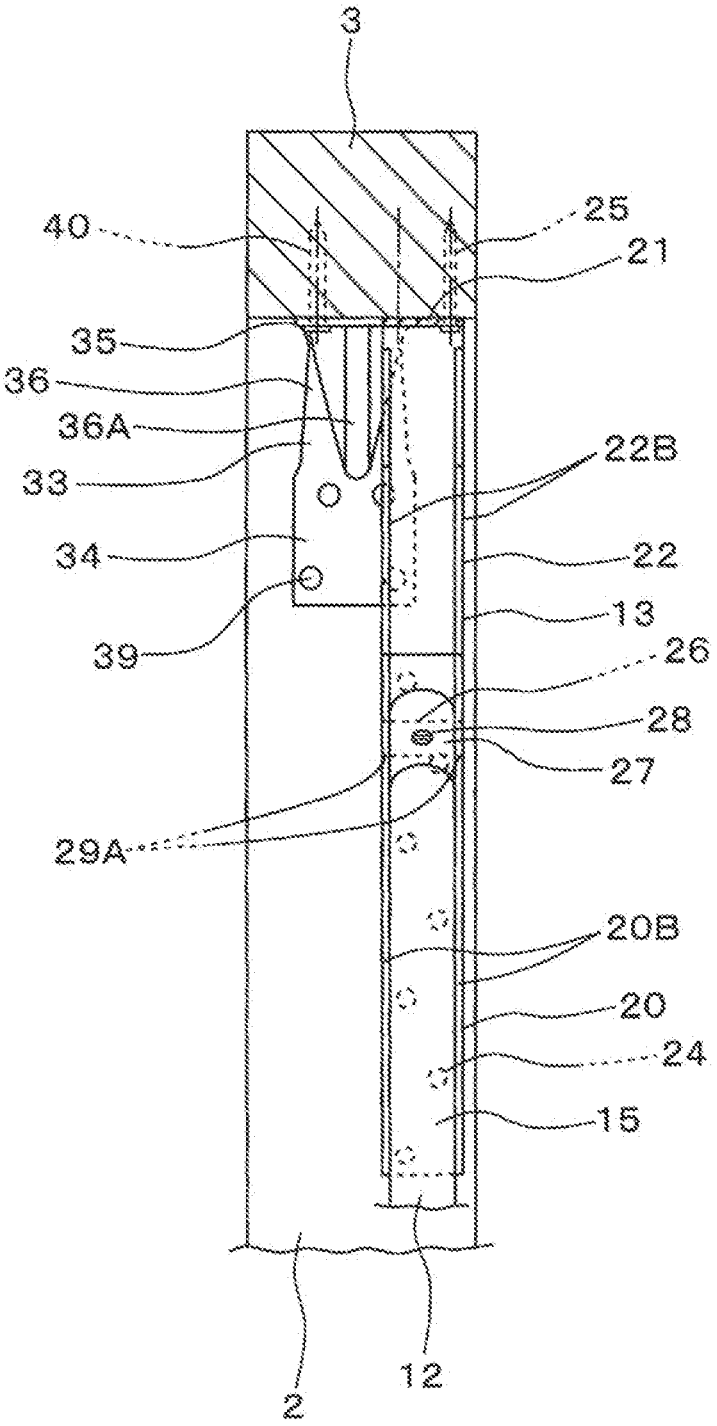
FIG. 8 is a cross sectional view of FIG. 1 taken along an S8-S8 line.

FIG. 8 is a cross sectional view of FIG. 1 taken along an S8-S8 line. As seen from FIGS. 8 and 5, an end of the brace body 15 of each of the braces 12 near the quadrangular frame 7 is inserted into between the pair of the flanges 20B of the vertical portion 20 of the bracket 13. To this end of the brace body 15, a connector 27 having a hole to which a pin 26 is inserted is connected. By inserting the pin 26 into a hole 29A (see FIG. 6A) formed on each of the pair of the flanges 20B and a hole of the connector 27, the end of the brace body 15 near the quadrangular frame 7 is connected to the quadrangular frame 7 in a manner to be rotatable around the pin 26 through each of the brace brackets 13.

As shown in FIG. 8, since a screw hole into which a setscrew 28 is screwed is formed on the connector 27, the pin 26 is prevented from slipping off the connector 27 and the pair of flanges 20B by screwing the setscrew 28 into the screw hole until the setscrew 18 contacts with the pin 26.

As described in relation to FIGS. 5 and 6, each of the brace brackets 13 includes the vertical portion 20 and the horizontal portion 21, in which the vertical portion 20 is fixed by the nails 24 to the posts 1 and 2 (vertical members) extending in the vertical direction among the main structural members defining the quadrangular frame 7, and the horizontal portion 21 is fixed by the nails 25 to the upper frame member 3 and the lower frame member 4 (horizontal members) extending in the horizontal direction, so that the attachment strength of the brace brackets 13 to the quadrangular frame 7 is increased.

With this arrangement, the vibration damping tool 11 (main member) of the vibration damper 10 is connected to the quadrangular frame 7 by the four braces 12 radially extending from the vibration damping tool 11 and the brace brackets 13 of the braces 12. Accordingly, an arrangement position of the vibration damping tool 11 relative to the quadrangular frame 7 is a center position of the quadrangular frame 7 in the vertical and horizontal directions in the front elevational view as shown in FIG. 1.

In the exemplary embodiment, in order to locate the vibration damping tool 11 at the center position of the quadrangular frame 7 in the vertical and horizontal directions in the front elevational view, each of the braces 12 includes a length adjuster 30 shown in FIG. 1. The length adjuster 30 is of a turnbuckle type, where the brace body 15 (formed of a tubular material) of each of the braces 12 is provided by two divided members 15A and 15B that are separated from each other at a position of the length adjuster 30, and the length adjuster 30 includes a rotary member 31 having both ends provided with a right screw shaft and a left screw shaft which are respectively screwed into a right screw hole and a left screw hole engraved inside the divided members 15A and 15B. When the rotary member 31 is rotated to the right or the left, the brace body 15 is extended or retracted so that the length of each of the braces 12 is adjusted. Accordingly, even when the brace brackets 13 are attached to the quadrangular frame 7 at deviated positions, such a deviation can be eliminated to make the arrangement position of the vibration damping tool 11 at the center position in the vertical and horizontal directions of the quadrangular frame 7 in the front elevational view.

In the exemplary embodiment, since each of the brace brackets 13 for connecting the vibration damping tool 11 to the quadrangular frame 7 through the braces 12 includes the inclined connecting portion 22 diagonally connecting the vertical portion 20 and the horizontal portion 21, even when the brace brackets 13 are fixed to the quadrangular frame 7 using the nails 24 and 25 as shown in FIG. 2, a right-triangular space S is left at each of the corners of the quadrangular frame 7. Accordingly, in the exemplary embodiment, a quadrangular-frame bracket 33 can be disposed in the space S. The quadrangular-frame bracket 33 is configured to connect the posts 1 and 2 (vertical members) extending in the vertical direction to the upper frame member 3 and the lower frame member 4 (horizontal members) extending in the horizontal direction, in which the posts 1 and 2, the upper frame member 3 and the lower frame member 4 are the structural members defining the quadrangular frame 7. With use of the quadrangular-frame bracket 33, the attachment strength of the posts 1 and 2, the upper frame member 3 and the lower frame member 4 can be increased.

In other words, in the exemplary embodiment, since each of the brace brackets 13 is shaped so as to allow provision of the quadrangular-frame bracket 33, even when each of the brace brackets 13 is disposed at each corner of the quadrangular frame 7, the quadrangular-frame bracket 33 can be disposed without interfering with each of the brace brackets 13.

Figure 7:
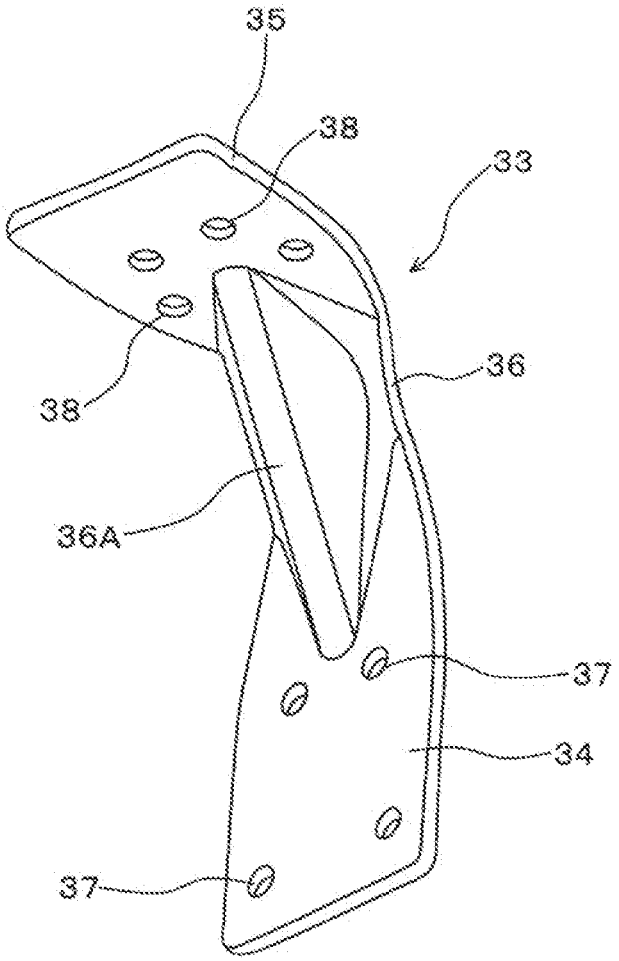
FIG. 7 is a perspective view showing a quadrangular-frame bracket for the quadrangular frame shown in FIG. 5.

FIG. 7 shows an outline of the quadrangular-frame bracket 33. Similar to the brace brackets 13, the quadrangular-frame bracket 33, which is an article obtained by bending a sheet metal or a cast article, also includes: a vertical portion 34 extending in the vertical direction; a horizontal portion 35 extending in the horizontal direction; and an inclined connecting portion 36 connecting the vertical portion 34 to the horizontal portion 35, in which the inclined connecting portion 36 includes a reinforcing rib 36A extending between the vertical portion 34 and the horizontal portion 35. Nail holes 37 and 38 are respectively formed on the vertical portion 34 and the horizontal portion 35. The vertical portion 34 is fixed to the posts 1 and 2 by a nail 39 (FIG. 5) inserted into the nail hole 37 of the vertical portion 34. The horizontal portion 35 is fixed to the upper frame member 3 and the lower frame member 4 by a nail 40 (FIG. 5) inserted into the nail hole 38 of the horizontal portion 35.

It should be noted that this operation of fixing the quadrangular-frame bracket 33 to the quadrangular frame 7 using the nails 39 and 40 is conducted before the brace brackets 13 of the vibration damper 10 are fixed to the quadrangular frame 7 using the nails 24 and 25.

Similar to the nail 24, the nail 39 also has a length enough to penetrate the posts 1 and 2 to reach the reinforcing posts 5 and 6.

Further, in the exemplary embodiment, as described above, the reinforcing posts 5 and 6 are respectively disposed on the horizontally outer sides of the posts 1 and 2 in the front elevational view. However, the reinforcing posts 5 and 6 may be disposed on horizontally inner sides of the posts 1 and 2 in the front elevational view and the nails 24 and 39 may have the length enough to penetrate the reinforcing posts 5 and 6 to reach the posts 1 and 2.

FIG. 8 shows the brace bracket 13 and the quadrangular-frame bracket 33 fixed to the quadrangular frame 7. FIG. 1 is the front elevational view. FIG. 8 is the cross sectional view of FIG. 1 taken along the S8-S8 line and a lateral side view that is a right-angular view in a direction orthogonal to the front elevational view. The brackets 13 and 33 partially overlap with each other in the lateral side view as shown in FIG. 8. However, since the brace bracket 13 in the front elevational view is shaped to form the right-triangular space S between the brace bracket 13 and the quadrangular frame 7 and the quadrangular-frame bracket 33 is disposed in the space S as described in relation to FIG. 5, the two brackets 13 and 33 do not interfere with each other in the front elevational view.

Since the quadrangular frame 7 shown in the front elevational view in FIG. 1 is a part of a building built by the two-by-four construction method as described above, a center post 45 is provided between two members (i.e., the upper frame member 3 and the lower frame member 4) vertically facing each other among the structural members defining the quadrangular frame 7. The center post 45 that is a bridging member configured to bridge a gap between the upper frame member 3 and the lower frame member 4 in order to increase the strength of the quadrangular frame 7 is wooden-made in the same manner as the posts 1 and 2, the upper frame member 3, the lower frame member 4 and the reinforcing posts 5 and 6. The center post 45 is nailed to the upper frame member 3 and the lower frame member 4. The center post 45 to be arranged inside the quadrangular frame 7 is at the center position of the posts 1 and 2 as shown in FIG. 1. Accordingly, when a distance between the posts 1 and 2 is defined as L1, the center post 45 is disposed at a position apart from the posts 1 and 2 by a distance L2, which is half of L1. When L1 is 910 mm, L2 is 455 mm.

When the center post 45 is thus disposed at the center position between the posts 1 and 2, since the vibration damping tool 11 of the vibration damper 10 is arranged to the quadrangular frame 7 at the center position of the quadrangular frame 7 in the vertical and horizontal directions as described above, a part of the center post 45 overlaps on the vibration damping tool 11 in the front elevational view as shown in FIG. 1.

For this reason, an interference avoidance portion 46 for avoiding interference with the vibration damping tool 11 is provided to the center post 45 as shown in FIG. 3. The interference avoidance portion 46 is provided in a form of a concave portion 47 at the vertical center of the center post 45, the concave portion 47 being formed to have a vertical length enough to receive the vibration damping tool 11 therein. FIG. 3 is a lateral side view that is a right-angular view in a direction orthogonal to the front elevational view shown in FIG. 1. Accordingly, in the lateral side view, the concave portion 47 is formed to the center post 45 as the interference avoidance portion 46 for avoiding interference between the center post 45 and the vibration damping tool 11.

The concave portion 47 in the exemplary embodiment is provided in a form of a cut portion 48 formed by cutting out a part of the center post 45. As seen from FIGS. 1 and 2, the cut portion 48 reaches two surfaces on both sides in the width direction of the center post 45 (i.e., right and left lateral surfaces of the center post 45) in the front elevational view. Moreover, as seen from FIG. 3 (lateral side view), the cut portion 48 has a depth from a front surface 45A of the center post 45 in the front elevational view. A material for the center post (also referred to as a center-post material) is used for preparing the center post 45, in which the cut portion 48 is formed on the center-post material. The center-post material (i.e., a material for the bridging member) has a constant cross section continuously in a length direction of the center post 45, the cross section being orthogonal to the length direction. The center post 45 is obtained by cutting a part of the center-post material at a lengthwise center of the center-post material to form the cut portion 48 reaching the two surfaces on both the sides in the width direction of the center-post material in the front elevational view and having a depth from a surface of the center-post material. The cut portion 48 defines the concave portion 47 having a vertical length larger than a vertical length of the vibration damping tool 11.

A depth of the quadrangular frame 7 shown in the front elevational view is defined as T as shown in FIG. 3. As seen from FIG. 3, the vibration damping tool 11, the brace 12 and the brace bracket 13 (the structural members of the vibration damper 10) are disposed not at a center position N of the depth T but at a position shifted from the center position N toward the front surface 45A of the center post 45 (i.e., the front surface of the above center-post material). With this arrangement, the cut portion 48 having the depth from the front surface 45A of the center post 45 is formed on the center post 45 and the cut portion 48 can be provided in a form of the concave portion 47 capable of receiving the vibration damping tool 11 therein. Moreover, with a simple arrangement that the cut portion 48 is provided to the center post 45, the center post 45 can be disposed to the quadrangular frame 7 without interfering with the vibration damping tool 11 in the lateral side view.

Further, by providing the vibration damping tool 11, the brace 12 and the brace bracket 13 not at the center position N of the depth T but at the respective positions shifted from the center position N toward the front surface 45A of the center post 45, the depth of the concave portion 47 can be decreased, thereby ensuring the strength of the center post 45.

Figure 4:
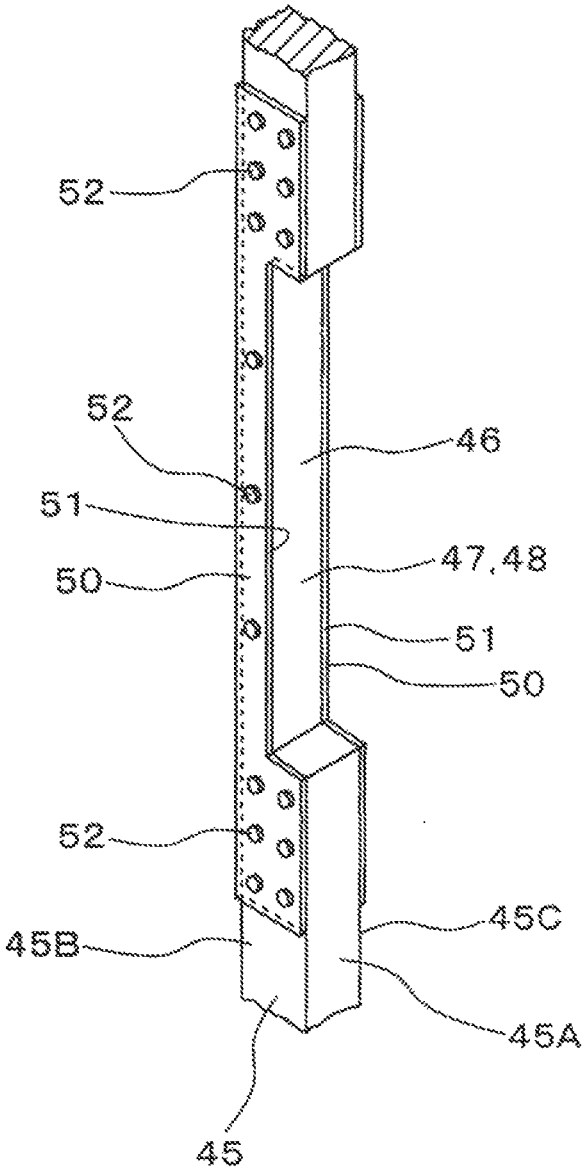
FIG. 4 is a perspective view showing a relevant part of a center post that is a bridging member shown in FIGS. 1 to 3.

FIG. 4 is a perspective view of the center post 45 at the lengthwise center position. A plate-shaped reinforcing member 50 is bonded to each of two lateral surfaces 45B and 45C on both sides in the width direction (i.e., on the right and left sides) of the center post 45 in the front elevational view. The reinforcing member 50 is made of metal such as steel having a larger strength than that of the wooden center post 45. The reinforcing member 50 has a length in the length direction of the center post 45, the length being sufficient for an area of the center post 45 including the cut portion 48 to be covered. The reinforcing member 50 has a dent 51 having the same shape as that of the cut portion 48 at a position corresponding to the cut portion 48. The reinforcing member 50 is bonded to the center post 45 by a stopper 52 such as a nail.

Accordingly, in the exemplary embodiment, even when the cut portion 48 is formed on the wooden center post 45 as the concave portion 47 for receiving the vibration damping tool 11 therein, the strength of the center post 45 can also be secured by the reinforcing member 50. Consequently, the strength of the quadrangular frame 7 can be improved as desired by the center post 45.

Figure 9:
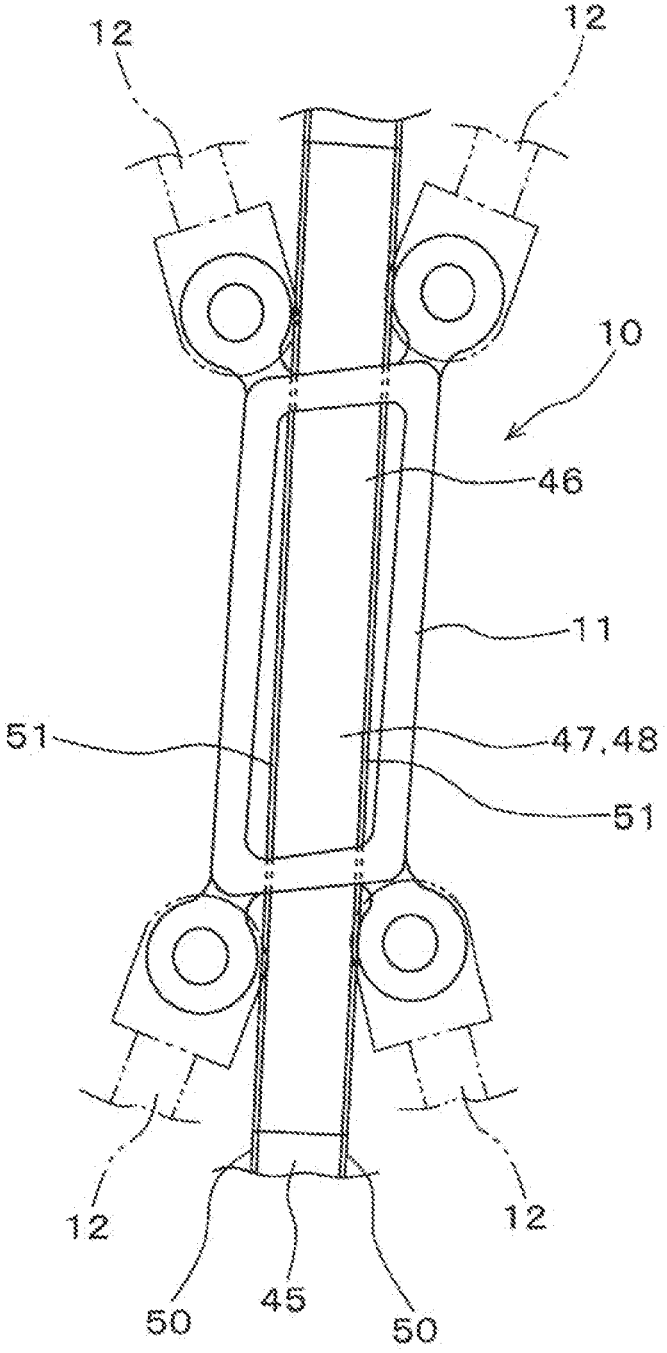
FIG. 9 shows the vibration damping tool of the vibration damper in the same manner as in FIG. 2, in which the vibration damping tool is plastically deformed by vibration energy.

FIG. 9 shows the vibration damping tool 11 of the vibration damper 10 when a lateral load generated by an earthquake and the like is applied to the quadrangular frame 7. Deformation of the quadrangular frame 7 caused by the lateral load is transmitted to the vibration damping tool 11 through the above-described brace brackets 13 and braces 12. As shown in FIG. 9, the vibration damping tool 11 is plastically deformed into a diamond shape or substantially diamond shape in the front elevational view, whereby vibration energy generated by the deformation of the quadrangular frame 7 is absorbed in the vibration damping tool 11, so that vibration of the quadrangular frame 7 is damped.

Even when the vibration damping tool 11 is plastically deformed into a diamond shape or substantially diamond shape in the front elevational view, since the cut portion 48 of the center post 45 and the dent 51 of the reinforcing member 50 each have the same vertical length as that of the vibration damping tool 11, the plastically deformed vibration damping tool 11 can be received inside the cut portion 48 and the dent 51 in the same manner as before the vibration damping tool 11 is plastically deformed, so that the vibration damping tool 11 can be prevented from interfering with the center post 45 and the reinforcing member 50 before and after the vibration damping tool 11 is plastically deformed.

Moreover, in the exemplary embodiment, as shown in FIG. 6A, the brace bracket 13 for connecting the brace 12 of the vibration damper 10 to the quadrangular frame 7 has not only the hole 29A but also a hole 29B formed at a position vertically shifted from the hole 29A. Together with the pin 26 (FIG. 5) serving as the connector for connecting the respective braces 12 to the brace brackets 13, the holes 29A and 29B define a connecting portion for connecting the respective braces 12 to the brace brackets 13. Specifically, the holes 29A and 29B define two vertically-shifted connection positions for connecting the respective braces 12 to the brace brackets 13, on the flange 20B of each of the brace brackets 13.

Accordingly, the brace brackets 13 according to the exemplary embodiment are configured so that the connection positions thereof to the respective braces 12 are changeable in the vertical direction.

Figure 10:
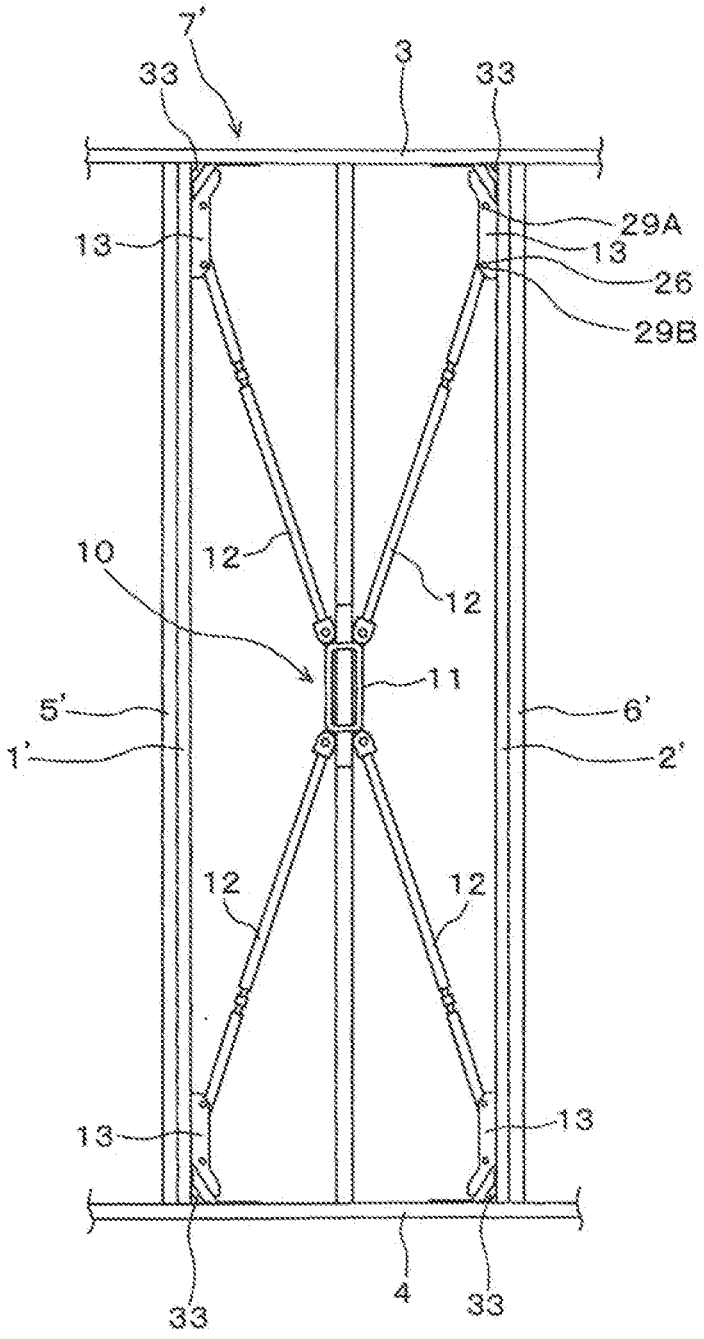
FIG. 10 shows a vertically large quadrangular frame in the same manner as in FIG. 1, in which a connection position between the brace of the vibration damper and the brace bracket is changeable.

FIG. 10 shows the brace brackets 13 respectively connected with the braces 12 at positions changed in the vertical direction from the positions shown in FIG. 1. A quadrangular frame 7' shown in FIGS. 10 includes: posts 1' and 2' each having a length vertically longer than those of the posts 1 and 2 of the quadrangular frame 7; and reinforcing post 5' and 6' each having a length vertically longer than those of the reinforcing posts 5 and 6.

By inserting the pin 26 for connecting the respective braces 12 to the brace brackets 13 into the hole 29B among the two holes 29A and 29B formed on the brace brackets 13 in a vertically shifted manner, the respective braces 12 are connectable to the brace brackets 13 even in the quadrangular frame 7' having a vertically longer length than that of the quadrangular frame 7 of FIG. 1. Accordingly, the brace brackets 13 are usable for both of the quadrangular frames 7 and 7'.

Figure 11:
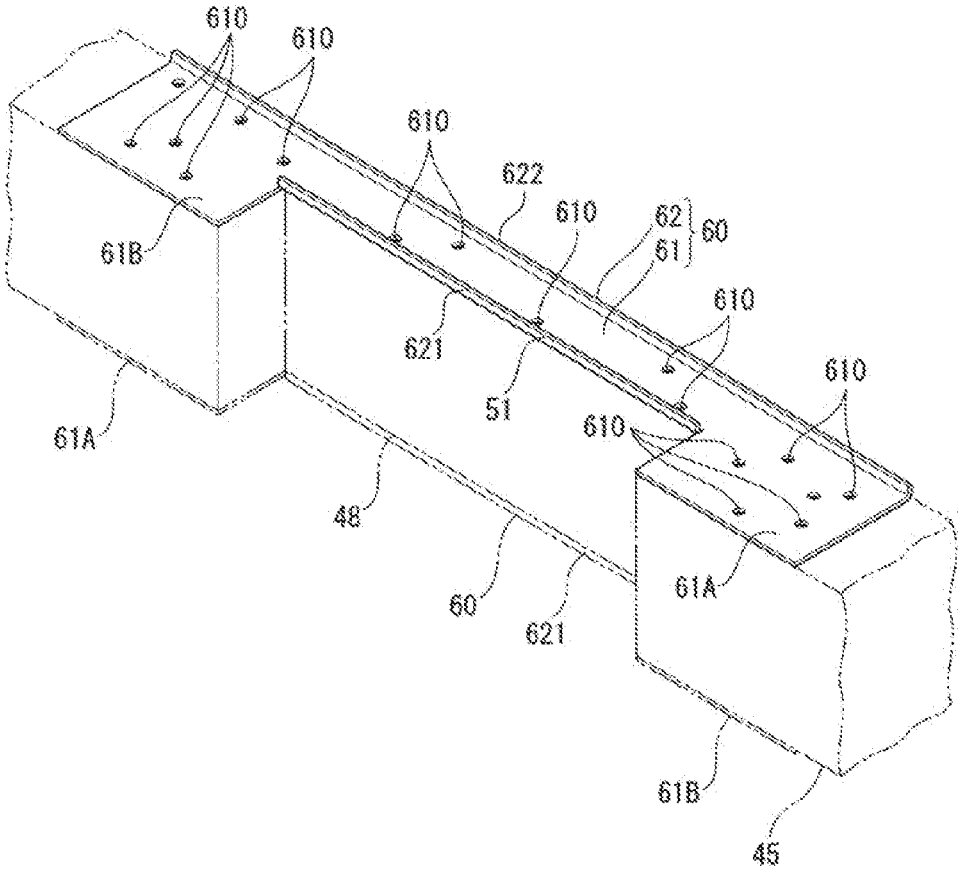
FIG. 11 is a perspective view showing a reinforcing member different from a reinforcing member shown in FIG. 4.
Figure 12:
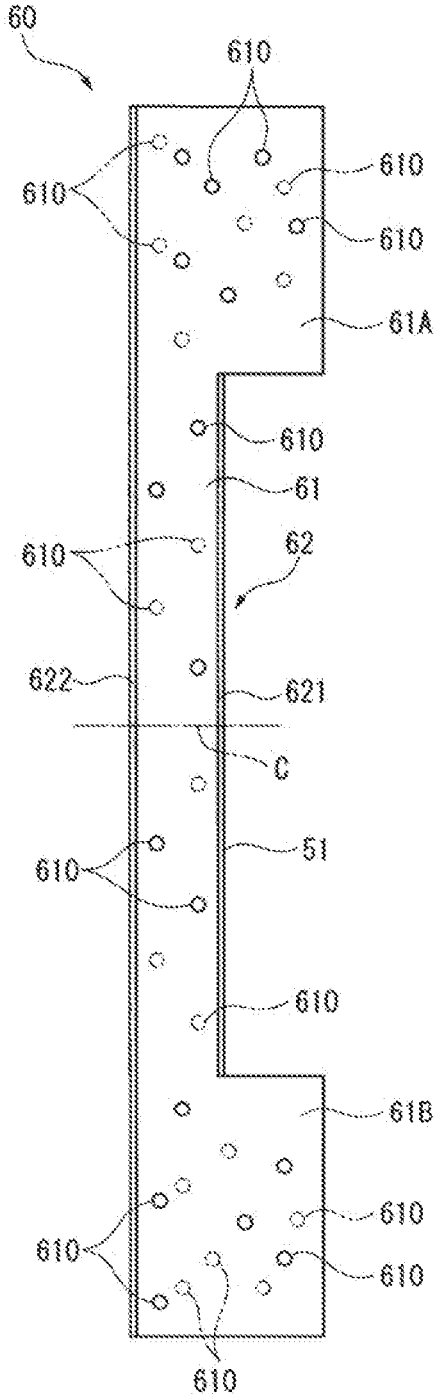
FIG. 12 is a front elevational view showing the reinforcing member shown in FIG. 11.
Figure 13:
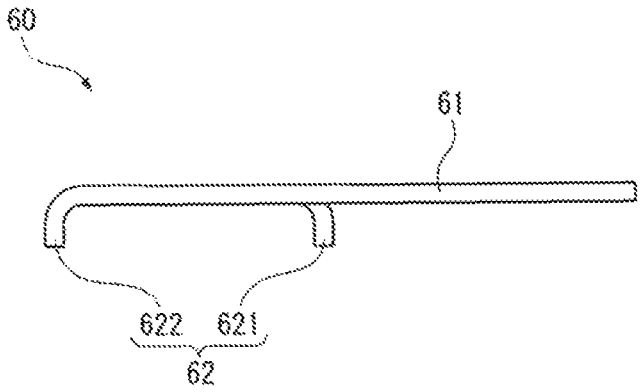
FIG. 13 is a top plan of the reinforcing member shown in FIG. 11.

FIGS. 11 to 13 show a reinforcing member different from the reinforcing member shown in FIG. 4. FIG. 11 is a perspective view showing the reinforcing member. FIG. 12 is a front elevational view showing the reinforcing member. FIG. 13 is a top plan showing the reinforcing member.

In the above figures, a reinforcing member 60 is formed of the same metal material as the reinforcing member 50 and includes: an elongated plate portion 61; and a rising portion 62 formed on the plate portion 61 along the length direction of the center post 45, in the same manner as the reinforcing member 50.

The plate portion 61 has the dent 51 shaped the same as the cut portion 48 of the center post 45. The plate portion 61 includes first and second ends 61A and 61B across a portion formed with the dent 51.

A plurality of stopper holes 610 for fixing the plate portion 61 to the center post 45 using the stopper 52 (see FIG. 4) are formed on the plate portion 61. The stopper holes 610 are asymmetrically provided relative to a center position C in a length direction of the plate portion 61 (i.e., in the length direction of the center post 45). When the reinforcing members 60 (first and second reinforcing members 60) are respectively disposed to two surfaces on both sides in the width direction of the center post 45, the reinforcing members 60 are disposed so that the first and second ends 61A and 61B of the first reinforcing member 60 are respectively reverse to the first and second ends 61A and 61B of the second reinforcing member 60 relative to the center position C. Specifically, the first end 61A of the first reinforcing member 60 and the second end 61B of the second reinforcing member 60 are positioned across the center post 45 to face each other, while the second end 61B of the first reinforcing member 60 and the first end 61A of the second reinforcing member 60 are positioned across the center post 45 to face each other. In this condition, positions (shown in a solid line in FIG. 12) of the stopper holes 610 formed on the first reinforcing member 60 do not interfere with positions (shown in an imaginary line in FIG. 12) of the stopper holes 610 formed on the second reinforcing member 60 in the right-angular view described above. With this arrangement, since only one type of the reinforcing member is required in order to fix the reinforcing members 60 to two surfaces of the center post 45, a construction cost can be saved.

The rising portion 62 includes: a first rising portion 611 provided at an edge of the plate portion 61 on which the dent 51 is formed and formed along the length direction of the plate portion 61; and a second rising portion 612 provided at an edge of the plate portion 61 opposite to the dent 51 and formed along the length direction of the center post 45. With this arrangement, since rigidity of the reinforcing member 60 can be improved, the strength of the center post 45 can be secured by the reinforcing member 50. Although one of the first rising portion 611 and the second rising portion 612 is sufficient in the arrangement according the exemplary embodiment, the rigidity of the reinforcing member 60 can be more improved when both of the first rising portion 611 and the second rising portion 612 are provided.

The invention is applicable to various constructions including buildings built by the two-by-four construction method.

What is claimed is:

1. A construction component provided with a vibration damper, the construction component comprising:

a quadrangular frame that is quadrangular in a front elevational view and is provided by members including four structural members;

the vibration damper comprising:

a vibration damping tool provided to an inner side of the quadrangular frame; and four braces radially extending from the vibration damping tool and connected to the quadrangular frame, wherein the quadrangular frame is deformable by vibration energy and the vibration energy is transmitted via the braces to the vibration damping tool to plastically deform the vibration damping tool, thereby absorbing the vibration energy in the vibration damping tool to damp vibration; and a bridging member configured to bridge a gap between two facing structural members of the four structural members, wherein a part of the bridging member is configured to overlap with the vibration damping tool in the front elevational view and is defined as an interference avoidance portion in which an interference between the part of the bridging member and the vibration damping tool is avoided in a right-angular view in a direction orthogonal to the front elevational view, the interference avoidance portion is in a form of a concave portion provided to the bridging member and configured to receive the vibration damping tool, and the concave portion comprises a vertical length larger than a vertical length of the vibration damping tool.

2. The construction component provided with the vibration damper according to claim 1, wherein the bridging member comprises a cut portion formed by cutting a bridging-member material in a middle of a length direction thereof, the bridging-member material having a cross section orthogonal to the length direction that is continuously constant in the length direction, the cut portion reaching two surf aces on both sides in a width direction of the bridging-member material in the front elevational view and comprising a depth from a surface of the bridging-member material, and the cut portion defines the concave portion.

3. The construction component provided with the vibration damper according to claim 2, wherein the vibration damping tool is shifted from a center position in a depth direction of the quadrangular frame in the front elevational view toward the surface of the bridging-member material defining a surface of the bridging member.

4. The construction component provided with the vibration damper according to claim 2, further comprising:

a reinforcing member connected to each of the two surfaces of both the sides in the width direction of the bridging member in the front elevational view.

5. The construction component provided with the vibration damper according to claim 4, wherein the reinforcing member has a length in a length direction of the bridging member comprising the cut portion and a dent having the same shape as that of the cut portion at a position corresponding to the cut portion.

6. The construction component provided with the vibration damper according to claim 4, wherein the reinforcing member comprises: a plate portion having a length in the length direction of the bridging member; and a rising portion formed on the plate portion along the length direction of the bridging member.

7. The construction component provided with the vibration damper according to claim 4, wherein the reinforcing member comprises a plurality of stopper holes for fixing the reinforcing member to the bridging member using a stopper, and the stopper holes are asymmetrically arranged on the reinforcing member relative to a center position of the length direction of the bridging member.

8. The construction component provided with the vibration damper according to claim 1, wherein the four structural members of the quadrangular frame are provided by right and left posts, and an upper frame member and a lower frame member vertically provided between the right and left posts, and the bridging member is provided by a center post provided at a center position between the right and left posts.

* * * * *